US006582220B2

(12) United States Patent
Heck et al.

(10) Patent No.: US 6,582,220 B2
(45) Date of Patent: Jun. 24, 2003

(54) IGNITOR ASSEMBLY FOR A FOSSIL FUEL-FIRED POWER GENERATION SYSTEM

(75) Inventors: Kenneth J. Heck, Enfield, CT (US); Raymond D. MacWhinnie, Jr., Springfield, MA (US); David J. Matteson, Avon, CT (US); Ronald H. Nowak, East Longmeadow, MA (US)

(73) Assignee: ALSTOM Power Inc., Windsor, CT (US)

( * ) Notice: Subject to any disclaimer, the term of this patent is extended or adjusted under 35 U.S.C. 154(b) by 167 days.

(21) Appl. No.: 09/812,430

(22) Filed: Mar. 20, 2001

(65) Prior Publication Data

US 2001/0051322 A1 Dec. 13, 2001

Related U.S. Application Data

(63) Continuation of application No. 09/364,580, filed on May 9, 2000, now abandoned.

(51) Int. Cl.[7] ..... F23Q 3/00; H01T 13/20; H01T 13/04

(52) U.S. Cl. ..... 431/258; 439/32; 439/33; 313/135; 313/118; 313/11.5

(58) Field of Search ..... 431/258, 264, 431/265, 266; 123/169 R, 169 EC, 169 EL, 169 PA, 169 EB; 60/39.827; 313/135, 122, 118, 11.5, 126, 325, 141, 144; 439/9, 2, 32, 33, 293, 295

(56) References Cited

U.S. PATENT DOCUMENTS 2,109,029 A * 2/1938 Nowosielski ..... 174/15.3
2,129,961 A * 9/1938 Rabezzana ..... 174/35 SM
2,351,066 A * 6/1944 Race ..... 313/137
2,365,219 A * 12/1944 Rose ..... 439/126
2,385,191 A * 9/1945 Brunelle, Jr. ..... 174/35 SM
2,398,359 A * 4/1946 Curtiss ..... 439/127
2,399,390 A * 4/1946 Robertson ..... 439/126
2,452,847 A * 11/1948 Frei ..... 174/35 SM
2,459,286 A * 1/1949 Rabezzana et al. ..... 313/11.5
2,459,855 A * 1/1949 Wall ..... 315/85
2,604,510 A * 7/1952 Berkey ..... 313/126
2,651,298 A * 9/1953 Brinson et al. ..... 313/135
2,889,530 A * 6/1959 Straub et al. ..... 439/2
2,913,696 A * 11/1959 Burgher ..... 439/126
3,050,658 A * 8/1962 Lay et al. ..... 315/85
3,239,704 A * 3/1966 Miller ..... 310/247
3,308,321 A * 3/1967 Provost, Jr. ..... 310/239
3,334,326 A * 8/1967 Besore et al. ..... 439/127
3,849,684 A * 11/1974 Duncan et al. ..... 310/242
4,266,841 A * 5/1981 Sherwood ..... 439/312
4,275,559 A * 6/1981 Blair ..... 60/39.827
4,715,337 A * 12/1987 Bohl et al. ..... 123/169 PA
5,083,932 A * 1/1992 Wyatt et al. ..... 439/126
5,127,840 A * 7/1992 Bezusko et al. ..... 439/127
RE34,152 E * 12/1992 Meyer ..... 356/301

* cited by examiner

*Primary Examiner*—Carl D. Price
(74) *Attorney, Agent, or Firm*—Russell W. Warnock

(57) ABSTRACT

An ignitor assembly for a fossil fuel-fired power generation system includes an elongate electrode, a tube sub assembly, and a coupling sub assembly, and an insulator sub assembly. The coupling sub assembly cooperates with other structural elements of the ignitor assembly and the respective windbox in which the ignitor assembly is installed to operably couple the elongate electrode to an external electrical power source. The ignitor assembly includes a contact socket secured by crimping to a lead of the external electrical power source which is biased into an electric current communicating disposition with the electrode rod of the ignitor assembly.

2 Claims, 4 Drawing Sheets

IGNITOR ASSEMBLY FOR A FOSSIL FUEL-FIRED POWER GENERATION SYSTEM

This is on continuation of Ser. No. 09/364,580 filed on May 20, 2000 now abandoned.

BACKGROUND OF THE INVENTION

The present invention relates to an ignitor assembly for a fossil fuel-fired furnace.

Ignitors are provided in fossil fuel-fired furnaces to start or supplement the combustion activities in the furnaces. For example, in one known type of coal-fired unit, coal to be burned in the furnace is dried and pulverized in a coal mill and delivered directly from the coal mill to the load-carrying coal nozzles in the furnace. Operation of the coal mills requires that heated air be supplied to the mills for drying and conveying the coal. This air is supplied by a forced-draft fan that forces the air through an air preheater, a device that uses the hot products of combustion in the furnace to preheat the air. This preheated primary air, the air used for drying and conveying coal, is delivered with the coal to the coal nozzles and used to support combustion. The primary air is typically not sufficient in quantity to support combustion of all the coal, so secondary air is brought directly from the air preheater to the furnace to supply the rest of the air needed for combustion. The coal thus supplied with air is caused to burn due to ignition energy from the primary air, the secondary air, the heat in the coal itself, radiation and conduction from flame in the furnace, and radiation from furnace walls.

It is to be noted that almost all of these combustion energy sources presuppose that the furnace has already been operating, and, in the large furnaces used in power generation, it presupposes that the furnace has been operating for a fairly long time. Accordingly, in order to cause and sustain combustion of the coal, it is necessary to use an auxiliary fuel for warming up the furnace walls, for providing ignition flame, and for warming up the air preheater. This is usually the function of oil- or gas-fired ignitors and warm-up guns.

In a typical installation, a relatively high-capacity oil burner is started by an ignitor, and this starts the process or warming up the furnace walls and the heat-exchange surfaces of the air preheater. Once the furnace has been brought up to temperature, the coal nozzles are ignited by oil- or gas-fired ignitors or by the warm-up guns themselves.

The use of auxiliary fuel is not necessarily over when the coal nozzles have started to supply coal. At higher boiler loads—that is, when the amount of coal supplied by the nozzles is great—the furnace can typically maintain stable combustion of the pulverized coal. However, when the load goes down and the coal supply is thereby decreased, the stability of the pulverized coal flame is also decreased, and it is therefore common practice to use the ignitors or warn-up guns to maintain flame in the furnace, thus avoiding the accumulation of unburned coal dust in the furnace and the associated danger of explosion.

Certain portions of an ignitor mounted in a windbox compartment of a furnace are subjected to relatively high temperatures on the order of 500 degrees Fahrenheit or higher. In some conventional ignitors, there is a risk that the ignitor wire may burn up In the event that insufficient cooling air contacts the ignitor. Another risk exists in that a loosely wrapped connection between the solid rod spark plug of the ignitor and the supply lead of the external electrical power source may result in inefficient spark transfer. Accordingly, the need exists for an improved ignitor assembly for a furnace which provides a reliable spark action and which has improved survivability in a high temperature environment.

SUMMARY OF THE INVENTION

It is one object of the present invention to provide an ignitor assembly for a fossil fuel-fired furnace which advantageously permits easier installation and removal of the ignitor assembly relative to its installed disposition in the furnace.

It is a further object of the present invention to provide an ignitor assembly for a fossil fuel-fired furnace which offers ease of installation and removal of the electrical wire or lead which connects the ignitor assembly to an external electrical source.

It is an additional object of the present invention to provide an ignitor assembly for a fossil fuel-fired furnace which, in comparison to conventional ignitor assemblies, reduces and simplifies the installation process or the removal process, respectively, of the ignitor assembly.

It is yet another object of the present invention to provide an ignitor assembly for a fossil fuel-fired furnace which offers a less complex, more robust configuration thus leading to improved reliability of the ignitor assembly in comparison to conventional ignitor assemblies.

It is a further additional object of the present invention to provide an ignitor assembly for a fossil fuel-fired furnace which has a configuration that advantageously disposes temperature sensitive elements, such as the electrical supply lead connecting elements, at a relatively greater spacing from the higher temperature environments of the furnace, as compared to conventional ignitor assemblies.

It is yet a further object of the present invention to provide an ignitor assembly for a fossil fuel-fired furnace which provides a coupling means for maintaining the electrode rod in connection with the supply lead of the external electrical source which is independent of the electrical communication interface between the electrode rod and the supply lead.

These and other objects of the present invention, which are intended to provide advantages over conventional ignitor assemblies, shall become apparent from the specification in which the preferred embodiment of the ignitor assembly of the present invention will be described and claimed.

According to one aspect of the present invention, there is provided an ignitor assembly for a fossil fuel-fired combustion furnace having an electrode rod and an elongate electrode rod housing for supporting therewithin the electrode rod. The elongate housing has an opening at one axial end for receiving therethrough an external electrical source connector which is operable to supply electrical current from an external electrical source. The ignitor assembly additionally includes means for electrically interconnecting the electrode rod connector and an external electrical source connector to one another. The electrically interconnecting means is operable to establish electrical communication between the electrode rod connector and the external electrical source connector when the electrode rod connector and the external electrical source connector are disposed at respective predetermined positions relative to one another forming a communication interface through which electrical current flows between the electrode rod connector and the external electrical source connector. The ignitor assembly further includes means remote from the communication interface for biasing the electrode rod connector and the external electrical source connector into their respective predetermined positions forming the communication interface whereby a reliable electrical current path is maintained between the external electrical source and the electrode rod.

Preferably, the remote biasing means of the ignitor assembly includes means for resiliently biasing the electrode rod connector and the external electrical source connector into their respective predetermined positions forming the communication interface. Moreover, it is preferable that the electrically interconnecting means includes a contact socket secured to the external electrical source connector and having a receiving chamber for receiving therein the electrode rod connector. Additionally, it is preferred that the means for resiliently biasing includes means for engaging the contact socket to bias the contact socket in a direction toward the electrode rod connector.

DETAILED DESCRIPTION OF THE PREFERRED EMBODIMENT

Figure 1:
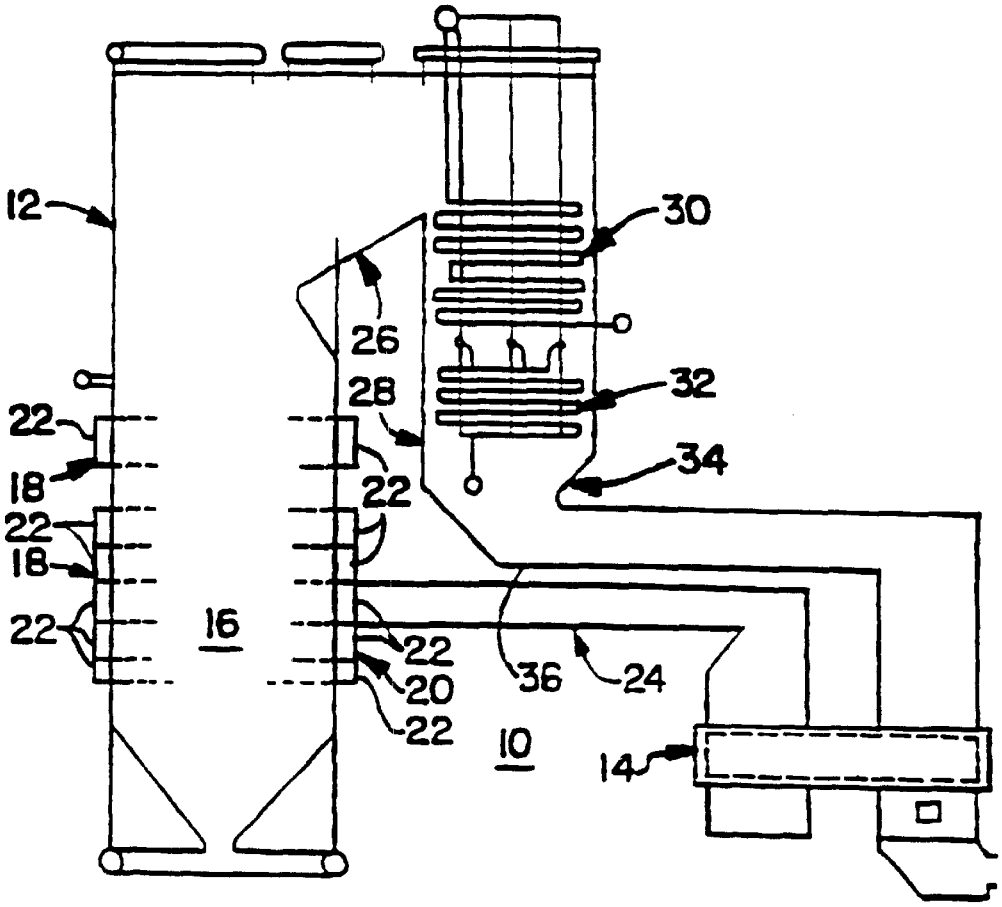
FIG. 1 is a schematic plan view of a fossil fuel-fired furnace having the preferred embodiment of the ignitor assembly of the present invention installed thereon.

Referring now to the drawings, and more particularly to FIG. 1 thereof, there is depicted therein a conventional fossil fuel-fired power generation system, generally designated by the reference numeral 10, having installed therein the preferred embodiment of the ignitor assembly of the present invention. In accordance with the illustration thereof in FIG. 1, the fossil fuel-fired power generation system 10 includes a fossil fuel-fired steam generator, generally designated by the reference numeral 12, and an air preheater, generally designated therein by the reference numeral 14.

A brief description will first be provided of the fossil fuel-fired steam generator 12. In accordance with the illustration thereof in FIG. 1 of the drawing, the fossil fuel-fired steam generator 12 includes a burner region, generally designated in FIG. 1 by the reference numeral 16. It is within the burner region 16 of the fossil fuel-fired steam generator 12 that the combustion of fossil fuel and air, in a manner well-known to those skilled in this art, is initiated. To this end, the fossil fuel-fired steam generator 12 is provided with a firing system, generally designated by the reference numeral 18. By way of exemplification and not limitation, the nature of the construction of the firing system 18 may take the form of that which comprises the subject matter of U.S. Pat. No. 5,020,454.

The firing system 18 includes a housing preferably in the form of a windbox denoted generally in FIG. 1 by the reference numeral 20. The windbox 20 in a manner well-known to those skilled in this art is supported by conventional support means (not shown) in the burner region 16 of the fossil fuel-fired steam generator 12 such that the longitudinal axis of the windbox 20 extends substantially in parallel relation to the longitudinal axis of the fossil fuel-fired steam generator 12. Further, as denoted schematically at 22 in FIG. 1 the windbox 20 embodies in known fashion a plurality of compartments. In conventional fashion some of the compartments 22 are designed to function as fuel compartments from which fossil fuel is injected into the burner region 16 of the fossil fuel-fired steam generator 12, while others of the compartments 22 are designed to function as air compartments from which air is injected into the burner region 16 of the fossil fuel-fired steam generator 12. The fossil fuel, which is injected into the burner region 16 of the fossil fuel-fired steam generator 12 from the fuel compartments 22, is supplied to the windbox 20 by a fuel supply means not shown in the interest of maintaining clarity of illustration in the drawing. Similarly, at least some of the air, which is injected into the burner region 16 of the fossil fuel-fired steam generator 12 for purposes of effecting the combustion therewithin of the fuel that is injected thereinto, is supplied to the windbox 20 from the air preheater 14 through the duct, which is schematically depicted in FIG. 1 of the drawing wherein the duct is denoted generally by the reference numeral 24. For a more detailed description of the nature of the construction and the mode of operation of the firing system 18, one may have reference to the aforementioned U.S. Pat. No. 5,020,454.

Continuing with the description of the fossil fuel-fired steam generator 12, which is illustrated in FIG. 1 of the drawing, it is within the burner region 16 of the fossil fuel-fired steam generator 12, as has been mentioned previously herein, that the combustion of the fossil fuel and air, which is injected thereinto, is initiated. The hot gases that are produced from this combustion of the fossil fuel and air rise upwardly in the fossil fuel-fired steam generator 12. During the upwardly movement thereof in the fossil fuel-fired steam generator 12, the hot gases in a manner well-known to those skilled in this art give up heat to the fluid flowing through the tubes (not shown in the interest of maintaining clarity of illustration in the drawing) that in conventional fashion line all four of the walls of the fossil fuel-fired steam generator 12. Then, the hot gases flow through the horizontal pass, generally designated by the reference numeral 26, of the fossil fuel-fired steam generator 12, which in turn leads to the rear gas pass, generally designated by the reference numeral 28, of the fossil fuel-fired steam generator 12. Although not shown in FIG. 1 of the drawing in the interest of maintaining clarity of illustration in the drawing, it is to be understood that the horizontal pass 26 would commonly have suitably provided therewithin some form of heat transfer surface. Similarly, heat transfer surface, as illustrated at 30 and 32 in FIG. 1 of the drawing, is suitably provided within the gas pass 28. In this regard, the heat transfer surfaces 30 and 32 preferably are in the form of superheater surface and economizer surface, respectively. During the passage thereof through the rear gas pass 28 of the fossil fuel-fired steam generator 12, the hot gases give up heat to the fluid flowing through the tubes depicted in FIG. 1 of which the superheater 30 is comprised as well as to the fluid flowing through the tubes also depicted in FIG. 1 of which the economizer 32 is comprised.

Upon exiting from the rear gas pass 28 of the fossil fuel-fired steam generator 12 the hot gases are conveyed to the air preheater 14. To this end, the fossil fuel-fired steam generator 12 is connected from the exit end thereof, which is denoted generally in FIG. 1 by the reference numeral 34, to the air preheater 14 by means of duct work, which is denoted generally in FIG. 1 by the reference numeral 36. After passage through the air preheater 14, the now relatively cooler hot gases are further conducted to conventional treatment apparatus which are not illustrated in the interest of clarity.

Figure 2:
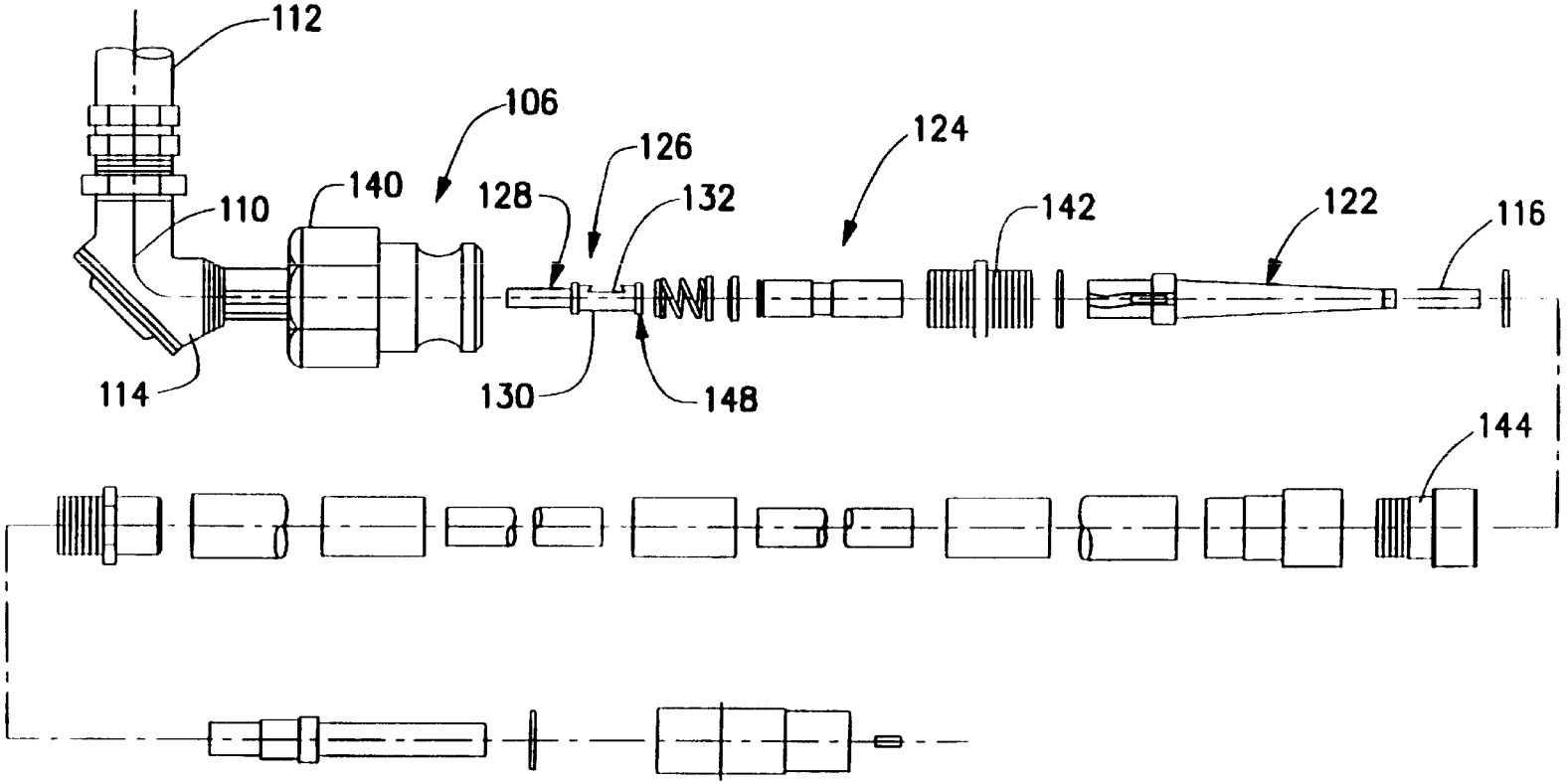
FIG. 2 is an enlarged exploded view, in partial vertical section, of the preferred embodiment of the ignitor assembly installed on the fossil fuel-fired furnace shown in FIG. 1.

The fossil fuel-fired steam generator 12 is provided with the preferred embodiment of the ignitor assembly of the present invention, hereinafter generally designated as the ignitor assembly 100, and this ignitor assembly 100 will now be described with respect to FIG. 2 which shows the ignitor assembly in its mounted disposition extending into a respective of the windboxes of the fossil fuel-fired steam generator 12. For purposes of the following description, the windbox 20 will be referred to as the respective windbox in which the ignitor assembly 100 is installed, it being understood that the fossil fuel-fired steam generator 12 can be provided with any desired number of the ignitor assemblies of the present invention. The ignitor assembly 100 includes a plurality of sub assemblies which are interconnected to one another in a manner to be described in more detail later. These sub assemblies of the ignitor assembly 100 comprise an elongate electrode 102, a tube sub assembly 104, and a coupling sub assembly 106, and an insulator sub assembly 108. The coupling sub assembly 106 cooperates with other structural elements of the respective windbox 20 to mount the ignitor assembly 11 in the windbox and, additionally, the coupling sub assembly 106 is operable to operably couple the elongate electrode 102 to an external electrical power source having one terminus shown in FIG. 2 in the form of a electrical supply lead 110 housed in a conduit 112. The electrical supply lead 110 is operable as an external electrical source connector for electrically connecting the ignitor assembly to the external electrical power source. One end of the conduit 112 is in the form of an elbow 114 which is fixedly mounted to a rear side of the respective windbox 20 remote from the furnace side opening of the windbox.

The electrode sub assembly 102 includes an electrode rod 116 having one axial end intermediately coupled via the coupling sub assembly 106 to the electrical lead 110 such that the electrode rod 116 receives electrical current and conducts the electrical current to its opposite axial end, generally designated as the electrode rod tip 118, at which, in cooperation with the tube sub assembly 104, a spark is created. The tube sub assembly 104 includes an elongate electrode rod housing preferably in the form of a tube 120 for supporting therein the major extent of the electrode rod 116. The tube 120 extends along the longitudinal extent of the respective windbox 20 and having one axial end coupled to the coupling sub assembly 106 and an opposite axial end adjacent the furnace open side of the windbox. The tube 120 has an overall elongate cylindrical shape adapted for accommodating therein both the major extent of the electrode rod 116, which extends generally along the longitudinal axis TLO of the tube, and elements of the insulating sub assembly 108 disposed intermediately the inner cylindrical surface of the tube and the major extent of the electrode rod 116.

At one axial end of the electrode rod 116, its electrode rod tip 118 extends relatively slightly axially beyond the furnace side axial end of the tube 120. The opposite axial end of the electrode rod 116 is housed in a ceramic surround housing 122 which circumferentially surrounds the opposite axial end at a uniform radial spacing therefrom and which extends axially beyond the opposite axial end. This opposite axial end of the electrode rod 116 may be in the form of a separate pin connected to the end of the major extent of the electrode rod and having a diameter different than the major extent of the electrode rod compatibly dimensioned with respect to a corresponding element of the coupling sub assembly 106 for interconnection therewith.

The tube 120 is preferably formed of stainless steel although other electrically conductive materials may be used in lieu of stainless steel. The elements of the insulating sub assembly 108 which are mounted within the tube 120 comprise a plurality of insulating spacers 124 each having an outer cylindrical surface compatibly dimensioned with respect to the inner diameter of the tube 120 for mounting of the spacer within the tube with substantially no freedom for radial movement of the spacer in a radial direction perpendicular to the tube axis TLO. Each insulating spacer 124 is also formed with a central cylindrical throughbore for insertion therethrough of the electrode rod 1 16 and compatibly dimensioned therewith such that the electrode rod is substantially precluded from radial movement within the central cylindrical throughbore. The insulating spacers 124 are individually mounted within the tube 120 at axial spacings from one another such that the spacers collectively engage and support the major extent of the electrode rod 116 in its co-axial mounting disposition within the tube. Each insulating spacer 124 is comprised of an electrically insulating material, preferably ceramic, for electrically insulating the electrode rod 116 from the tube 120.

The one axial end of the electrode rod 116 opposite the electrode rod tip 118 is operatively connected to the electrical lead 110 via an electrical lead connector sub assembly, generally designated as 126, which cooperates with the electrical lead 110 and the electrode rod 116 to ensure a reliable, continuous electrical current transmission connection therebetween. The electrical lead connector sub assembly 126 includes means for electrically interconnecting the electrical lead 110 and the electrode rod 116, preferably in the form of a bayonet type positive contact socket 128 having one end secured by, for example, crimping, to the end of the electrical lead 110. The contact socket 128 includes a hollow cylindrical receiving chamber 130 having an open axial end forming the opposite end of the engagement clip and a bias clip arm 132 biased to move radially inwardly relative to the longitudinal extent of the engagement clip into the interior of the hollow cylindrical receiving chamber 130. The hollow cylindrical receiving chamber 130 is operable to receive the interior axial end of the electrode rod 116 therein. In this regard, the opposite axial end of the electrode rod 116 is preferably configured in the form of a separate pin connected to the end of the major extent of the electrode rod and having a diameter compatibly dimensioned with respect to a corresponding element of the coupling sub assembly 106—namely, the hollow cylindrical receiving chamber 130—for insertion therein. It can thus be seen that the hollow cylindrical receiving chamber 130 and the bias clip arm 132 collectively operate as means for electrically interconnecting the electrode rod connector (the pin secured to the axial end of the electrode rod 116) and the external electrical source connector (the electrical lead 110) to one another. When the pin of the electrode rod 116 is at its respective predetermined position relative to the hollow cylindrical receiving chamber 130 at which the pin is nested within the receiving chamber 130 and engaged by the bias clip arm 132, a electrical communication interface is formed through which electric current flows between the electrode rod connector and the external electrical source connector.

The electrical lead connector sub assembly 124 also includes means remote from the electrical communication interface between the electrode rod connector and the external electrical source connector for biasing the electrode rod connector and the external electrical source connector into their respective predetermined positions forming the communication interface. This biasing means comprises a sleeve 134 having a hollow cylindrical interior of relatively greater diameter than the outside diameter of the contact socket 128 for freely movably receiving the contact socket 128 therewithin. The sleeve 134 includes a cylindrical shoulder 136 extending radially outwardly therefrom at an axial spacing from each axial end of the contact socket. A spring 138 is sized to be freely movably mounted over an axial extent of the contact socket 128 yet is of lesser diameter than the outer diameter of the cylindrical shoulder 136 such that one end of the spring 138 is in abutting engagement with the cylindrical shoulder in the assembled disposition of the ignitor assembly 100.

The coupling sub assembly 106 includes a mounting adapter 140 securable in an aperture in the windbox through which the ignitor assembly 100 is insert from the furnace outside side of the windbox. The mounting adapter 140 is formed with a hollow core for passage therethrough of the electrical lead 110 and the furnace side extent of the mounting adapter is formed with internal threads for threadably receiving a threaded interconnecting conduit section 142. The threaded interconnecting section 142 is also adapted to be threadably received in internal threads formed in an end cap 144 fixedly secured to the one axial end of the tube 120 such that the threaded interconnecting section 142 interconnects the mounting adapter 140 to the tube 120.

Figure 3A:
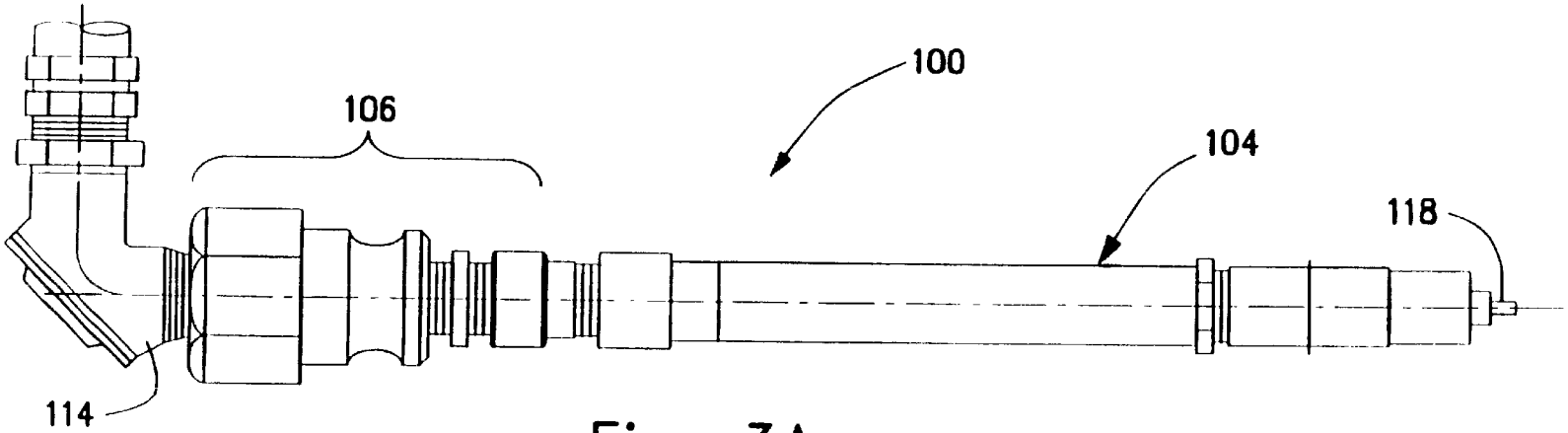
FIG. 3A is a plan view of the ignitor assembly shown in FIG. 2 in its assembled condition.
Figure 3B:
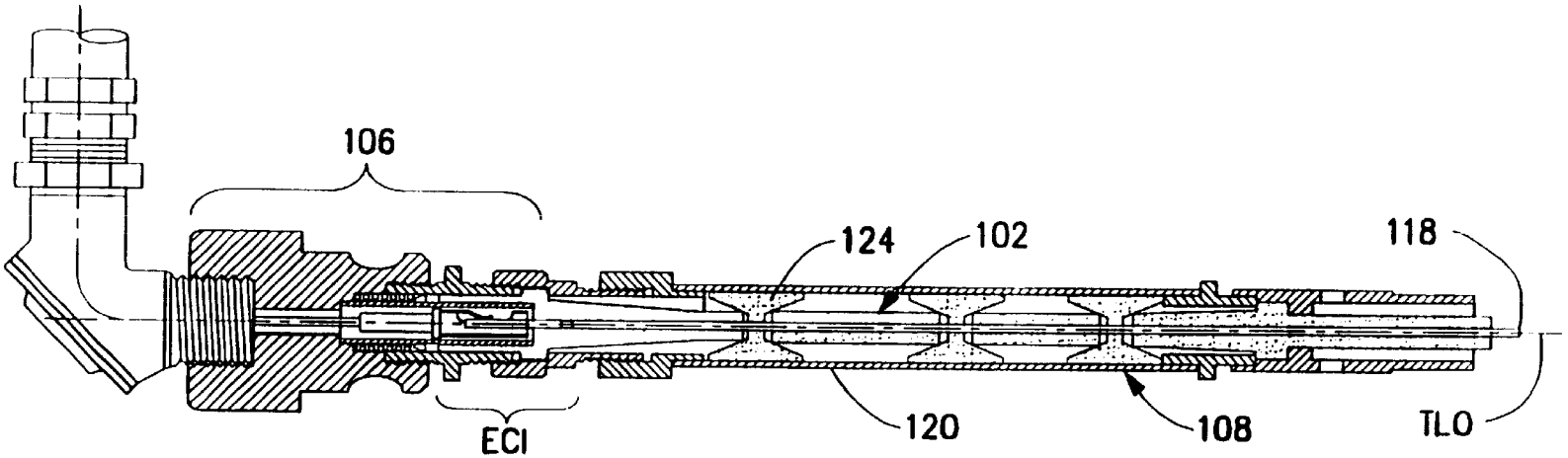
FIG. 3B is a plan view, in partial vertical section, of the ignitor assembly shown in FIG. 2 in its assembled condition.

Reference is now had to FIG. 3A, which is a front view, and FIG. 3B, which is a cutaway view, of the ignitor 100 in its assembled disposition for a more detailed description of the arrangement of the respective sub assemblies of the ignitor 100 with respect to each other. The major extent of the electrode rod 116 is received through the central cylindrical cores of the insulating spacers 124 and the insulating spacers 124 are mounted within the tube 120 at respective axial spacings from each other. The electrode rod tip 118 extends axially beyond the opposite axial end of the tube 120 and the one axial end of the electrode rod 116, which is circumferentially surrounded by the ceramic surround housing 122, extends axially beyond the respective end of the tube 120. The threaded interconnecting section 142 is threaded onto the end cap 144 on the tube 120 and the mounting adapter 140.

Figure 4:
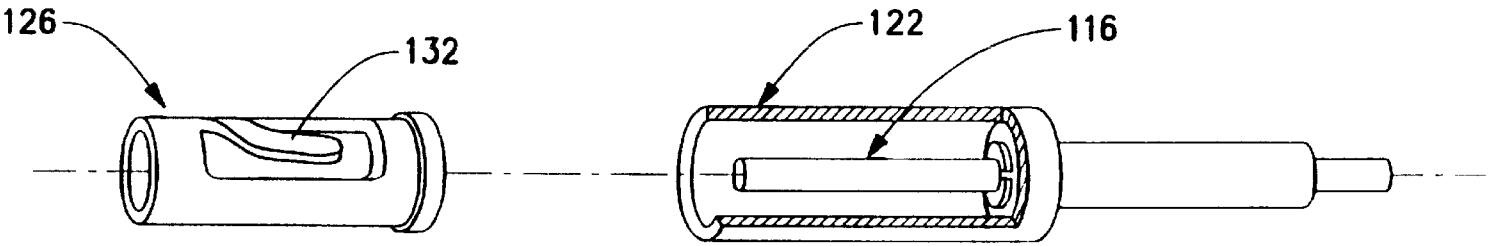
FIG. 4 is an enlarged exploded perspective view, in partial vertical section, of the contact socket and one axial end of the electrode rod of the ignitor assembly shown in FIG. 2.

The contact socket 128, one end of which is crimped to the electrical lead 110, is received in the sleeve 134 and the spring 138 is mounted over an axial extent of the sleeve in abutting engagement with the cylindrical shoulder 136. In turn, the sleeve 134 extends from one axial direction interiorly of the threaded interconnecting section 1423 and the ceramic surround housing 122 extends interiorly of the threaded interconnecting section 142 from the opposite axial direction. As seen in particular in FIG. 4, the one axial end of the electrode rod 116 extending into the ceramic surround housing 122 is received in the hollow cylindrical receiving chamber 130 of the contact socket 128 and is engaged by the clip arm 132 such that electrical current flows between the electrical lead 110 and the electrode rod 116. The interface along which the electrical lead 110 and the electrode rod 116 are in electrical contact with one another is hereinafter generally designated as the electric communication interface ECI.

Figure 5:
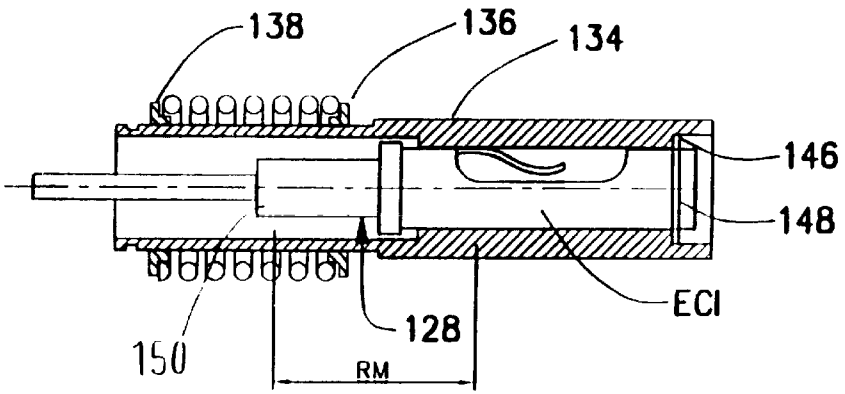
FIG. 5 is an enlarged vertical sectional view of the sleeve and the contact socket of the ignitor assembly shown in FIG. 2.

With reference now to FIG. 5, the sleeve 134 includes an inner cylindrical shoulder 146. A removable retaining ring 148 is disposed on the contact socket 128 axially between the clip arm 132 and the free axial end of the contact socket and is of a relatively larger diameter than the inner cylindrical shoulder 146 of the sleeve 134. The contact socket 128 is initially inserted into the sleeve 134 without the removable retaining ring 148 being secured thereto and, thereafter, the retaining ring 148 is secured on the contact socket 128. Accordingly, the sleeve 134 cannot now be moved axially past the free end of the contact socket 128 as any attempt to do so brings the inner cylindrical shoulder 146 of the sleeve 134 into abutting engagement with the retaining ring 148 of the contact socket 128.

One end of the spring 138 is in abutting engagement with the mounting adapter 140 such that the spring exerts on the sleeve 134, via its abutting engagement with the cylindrical shoulder 136, a biasing force in the axial direction toward the furnace interior. The inner cylindrical shoulder 146 of the sleeve 134 correspondingly exerts, via its engagement with the retaining ring 148, a biasing force on the contact socket 128 in the axial direction toward the furnace interior. The biasing force exerted on the retaining ring 148 of the contact socket 128 effects or causes a tension force on the sheathing of the electrical lead 110 due to the engagement of the sheathing by the contact socket 128 crimped thereon and this tension forces acts to bias the electrical lead 110 toward the pin of the electrode rod 116 to thereby promote reliable and continuous electrical contact between the external electrical current source and the electrode rod 116. The location at which the contact socket 128 exerts a biasing force on the electrical lead 110 is remote from the electrical communication interface ECI. Specifically, the location at which the contact socket is crimped to the sheathing of the electrical lead 110, hereinafter designated as the crimping location 150, is at a spacing RM from the electrical communication interface ECI.

The ignitor assembly 100 produces sparks at the electrode rod tip 118 at the gap formed between the oppositely charged tube 120 and the electrode rod tip. Due to the securement of the tube 120 to the mounting adapter 140, the ignitor assembly 100 is self-grounded from the spark point at the electrode rod tip 118 to the wall of the windbox 20 in which the mounting adapter 140 is mounted. If desired, the electrode rod tip 118 can be in the form of a platinum tip. Additionally, the ignitor assembly can be configured to be interchangeable with most 6 inch side-fire ignitor assemblies.

It can thus be appreciated that the ignitor assembly of the present invention advantageously provides the benefits of quick installation, improved ignition reliability, longer service life, and easier maintenance as compared to conventional ignitor assemblies. Moreover, the ignitor assembly of the present invention provides a more robust spark and can withstand higher temperatures for more prolonged periods than conventional designs.

While one embodiment of the invention has been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. An ignitor assembly for a fossil fuel-fired combustion furnace, comprising:

an electrode rod;

an elongate housing for supporting therewithin the electrode rod, the elongate housing having an opening at one axial end for receiving therethrough an electrical source connector which is operable to supply electrical current from an electrical source;

means for electrically interconnecting the electrode rod and an electrical source connector to one another, the electrically interconnecting means being operable to establish electrical communication between the electrode rod and the electrical source connector when the electrode rod and the electrical source connector are disposed at respective predetermined positions relative to one another forming a communication interface through which electrical current flows between the electrode rod and the electrical source connector, the means for electrically interconnecting including means for fixedly securing the electrical source connector thereto at a location to one side of the communication interface; and biasing means acting on the means for electrically interconnecting at a location thereon on the other side of the communication interface at a spacing from the communication interface to bias the means for electrically interconnecting in a direction from the electrical source connector toward the electrode rod connector, the electrical source connector being movable against the bias of the biasing means, as a result of which the respective predetermined positions of the electrode rod and the electrical source connector relative to one another change and, consequently, the position of the communication interface changes, and the electrical source and the electrode rod being in overlapping relationship with one another such that the electrical contact between the electrical source and the electrode rod continues throughout the range of positions to which the communication interface moves as a consequence of the movement of the electrical source against the bias of the biasing means.

2. An ignitor assembly for a fossil fuel-fired combustion furnace according to claim 1 wherein the means for electrically interconnecting includes a contact socket having a receiving chamber for fixedly securing the electrical source connector to the contact socket and a sleeve for receiving the contact socket inserted therein such that the sleeve engages the contact socket at least during the application of a force on the contact socket acting in a direction against the biasing direction and the means acting on the means for electrically interconnecting applies a biasing force to the sleeve, whereby the biasing force applied to the sleeve is applied by the sleeve to the contact socket.

* * * * *